US005259240A

United States Patent [19]

Raines et al.

[11] Patent Number: 5,259,240

[45] Date of Patent: Nov. 9, 1993

[54] DEVICE FOR IN SITU TESTING OF SOILS THAT INCLUDES A VENT VALVE ADAPTED TO CLOSE AT A PREDETERMINED DEPTH DURING INSTALLATION

[75] Inventors: Richard D. Raines, Houston; Ronald L. Boggess, Richmond; Wilson C. Lamb; John S. Templeton, III, both of Houston, all of Tex.

[73] Assignee: Exxon Production Research Company, Houston, Tex.

[21] Appl. No.: 862,868

[22] Filed: Apr. 3, 1992

[51] Int. Cl.[5] ..... G01N 3/00

[52] U.S. Cl. ..... 73/84

[58] Field of Search ..... 73/84, 12, 784, 866

[56] References Cited

U.S. PATENT DOCUMENTS

| | | | |
|---|---|---|---|
| 3,503,254 | 3/1970 | Menard | 73/88 |
| 3,798,962 | 3/1974 | Dibley etal. | 73/88 |
| 3,838,428 | 9/1974 | Benson et al. | 73/84 |
| 3,906,781 | 9/1975 | Vlasblom | 73/84 |
| 3,946,601 | 3/1976 | Yizhaki | 73/84 |
| 4,359,890 | 11/1982 | Coelus | 73/12 |
| 4,586,366 | 5/1986 | Milberger | 73/12 |
| 4,845,996 | 7/1989 | Bermingham | 73/807 |
| 5,127,261 | 7/1992 | Ingram et al. | 73/84 |

OTHER PUBLICATIONS

W. R. Cox et al., "Axial Load Tests on 14-inch Pipe Piles in Clay", Paper No. OTC 3491, presented at the 11th Annual Offshore Technology Conference in Houston, Texas, Apr. 30-May 3, 1979.

J. D. Bogard et al., "Three Years' Experience With Model Pile Segment Tool Tests", Paper No. OTC 4848, presented at the 17th Annual Offshore Technology Conference in Houston, Texas, May 6-9, 1985.

J. D. Bogard et al., "In-Situ Pile Segment Model Experiments at Empire, Louisiana", Paper No. OTC 6323, presented at the 22nd Annual Offshore Technology Conference in Houston, Texas, May 7-10, 1990.

J. D. Board et al., "In-Situ Pile Segment Model Experiments at Harvey, Louisiana", Paper No. OTC 6324, presented at the 22nd Annual OffShore Technology Conference in Houston, Texas, May 7-10, 1990.

J. D. Bogard et al., "Application of Model Pile Tests to Axial Pile Design", Paper No. OTC 6376, presented at the 22nd Annual Offshore Technology Conference in Houston, Texas, May 7-10, 1990.

M. R. Coop et al., "Field studies of an instrumented model pile in clay", *Geotechnique*, vol. XXXIX, No. 4, Dec. 1989, pp. 679-696.

M. J. Morrison, "The Piezo-Lateral Stress (PLS) Cell", chapter 3 from Phd thesis submitted to the Massachusetts Institute of Technology in 1984.

Boggess et al., "Advanced In-Situ Instruments for Studying the Behavior of Cyclically Loaded Friction Piles", presented at the 1983 American Society of Civil Engineers (ASCE) Annual Convention, Session 52, in Houston, Texas.

(List continued on next page.)

*Primary Examiner*—Hezron E. Williams
*Assistant Examiner*—Nashmiya Ashraf
*Attorney, Agent, or Firm*—Keith A. Bell

[57] ABSTRACT

A module model pile tool in situ testing of soils. The tool has an upper instrument section, a lower anchor section, and an axial slip joint located between the instrument section and the anchor section. The anchor section may be configured to model either open-end or closed-end piles. In the open-end configuration, a vent and vent valve are provided to vent trapped fluid during the initial stages of installation by remaining open only to a predetermined depth so as to permit formation of an undisturbed soil plug and to close in order to prevent fluids from being vented into the actual soil to be tested. The instrument section includes instrumentation for measuring axial loads, axial accelerations, pore water pressure, and total lateral pressure. Instrumentation for measuring axial displacement are included in the slip joint. The tool is rugged enough to permit installation by pile driving, and the instrumentation may be monitored both during and after installation.

5 Claims, 6 Drawing Sheets

OTHER PUBLICATIONS

L. M. Kraft Jr., et al., "Pile Load Tests: Cyclic Loads and Varying Load Rates", *Journal of Geotechnical Engineering*, ASCE, vol. 107, No. GT1, 1981, pp. 1–19.

N. S. Rad et al., "A New Offshore Soil Investigation Tool for Measuring the In Situ Coefficient of Permeability and Sampling Pore Water and Gas", presented at the Behavior of Offshore Structures International Conference [BOSS '88] at Trondheim, Norway, Jun. 1988, vol. 1, pp. 409–417.

A. S. Azzouz et al., "Shaft Behavior of a Model Pile in Plastic Empire Clays", *Journal of Geotechnical Engineering*, ASCE, vol. 112, No. 4, Apr. 1986, pp. 389–406.

DEVICE FOR IN SITU TESTING OF SOILS THAT INCLUDES A VENT VALVE ADAPTED TO CLOSE AT A PREDETERMINED DEPTH DURING INSTALLATION

FIELD OF THE INVENTION

This invention relates generally to the field of geotechnical engineering. More particularly, but not by way of limitation, the invention pertains to a device for in situ testing of soils.

BACKGROUND OF THE INVENTION

One of the primary applications of geotechnical engineering is in the design of foundations for offshore oil and gas platforms. One well known type of offshore platform comprises a welded steel framework, known as a "jacket structure", which rests on the floor of the body of water and supports the platform's drilling and producing facilities. Typically, the jacket structure is attached to the floor of the body of water by a plurality of elongated piles which are driven a predetermined distance into the underlying soils and are then grouted or otherwise attached to the jacket structure. These piles must be capable of transferring all axial and lateral loads acting on the platform to the underlying soils.

In recent years, a new type of offshore platform known as a "tension leg platform" or "TLP" has been developed, primarily for use in deep waters. Basically, a TLP comprises a buoyant hull which is attached to one or more foundation units on the floor of the body of water by a plurality of substantially vertical tethers. The length of the tethers is adjusted to maintain the buoyant hull at a greater draft than it would have if it were unrestrained. The resulting excess buoyancy exerts an upward tensile load on the tethers which must be resisted by the foundation units. Typically, the foundation units are attached to the floor of the body of water by a plurality of elongated piles which must be capable of withstanding these tensile loads for the life of the structure.

As will be evident from the above, the design of a pile foundation for an offshore platform can be of crucial importance. Unfortunately, the interaction between a steel foundation pile and the surrounding soils is very complex and is not well understood. Consequently, geotechnical engineers have expended substantial efforts in developing new tools to aid in understanding the various factors which influence the soil/pile interaction. A better understanding of these factors will help to ensure that pile foundations for future offshore platforms are safe and reliable.

Two of such geotechnical tools are described in Boggess, et al., "Advanced In-Situ Instruments for Studying the Behavior of Cyclically Loaded Friction Piles" presented at the 1983 American Society of Civil Engineers (ASCE) Annual Convention in Houston, Texas. Both of the tools described by Boggess, et al. are used in situ to simulate the behavior of short segments of a foundation pile. After being inserted into the soils, the tools measure local friction, local displacement, pore water pressure, and total lateral pressure under a variety of loading conditions.

One of these tools, known as the "X-probe", is similar in external configuration to a conventional cone penetrometer. It has a diameter of 1.72 inches, a length of 56.5 inches, and is capable of being deployed by existing cone penetrometer equipment. Its primary purpose is for routine site investigations at the proposed site of offshore oil and gas facilities.

The other tool described by Boggess et al. is 3 inches in diameter and has a total length of approximately 16 feet. It is primarily intended as a research tool for investigating the soil/pile interaction. It comprises a cutting shoe section which can simulate either an open-end or a closed-end pile and an instrument section which houses the various instruments used to measure the soil/pile interaction parameters. During loading, a slip joint permits relative axial movement between the instrument section and the cutting shoe section which serves to anchor the tool in the surrounding soils. This allows direct measurement of the shear-displacement characteristics of the soil/pile interaction.

Additional information on these two geotechnical tools can be found in Bogard, et al., "Three Years' Experience With Model Pile Segment Tool Tests", OTC 4848, presented at the 1985 Offshore Technology Conference in Houston, Tex.

Other in situ geotechnical tools have also been developed. See, for example, Coop, et al., "Field Studies of an Instrumented Model Pile in Clay", *Geotechnique*, December 1989, pp. 679–696 which describes a model pile tool developed at Oxford University. See also, Morrison, M. J., "The Piezo-Lateral Stress (PLS) Cell", Chapter 3 from Phd. thesis submitted to Massachusetts Institute of Technology, 1984, which describes a model pile tool developed at M.I.T.

One disadvantage of most prior model pile tools is that they are generally designed to be installed by pushing rather than by pile driving. Installation by pushing creates a different stress state in the surrounding soils than installation by pile driving. Accordingly, in order to accurately model the behavior of a full scale driven foundation pile, the model pile tool should be installed in the soils by pile driving rather than by pushing.

It should be noted that the Boggess, et al. paper discussed above indicates that both the X-probe and the 3-inch diameter model pile segment are designed to be inserted by driving or pushing. However, in actual practice, these tools were not rugged enough to be installed by driving in any but the softest of soils. In some types of soils, such as dense sands, pile driving results in very high impact loads and accelerations. None of the prior model pile tools was capable of withstanding these loads and accelerations.

Another disadvantage of prior model pile tools is their inability to measure dynamic loads and accelerations during installation by pile driving. Measurement of dynamic loads and accelerations would permit calculation of the dynamic skin friction between the pile and the surrounding soils. Dynamic skin friction, in combination with static skin friction, may be used to establish the damping parameters required for analyses of pile driving performance.

Accordingly, a need exists for an in situ model pile tool which is capable of being installed in dense soils by pile driving and which can be used to measure dynamic loads and accelerations during installation.

SUMMARY OF THE INVENTION

The present invention is a modular model pile tool for in situ testing of soils. The modular design permits the tool to be configured in a variety of different ways; however, in any configuration the tool comprises an upper instrument section, a lower anchor section, and an axial slip joint.

Preferably, the instrument section includes at least two axially spaced apart load cell modules and one effective stress module located approximately midway between the two load cell modules. The load cell modules include means for measuring both axial loads and axial accelerations. The effective stress module is adapted to measure both pore water pressure and total lateral pressure.

The anchor section may be adapted to simulate either a closed-end or an open-end pile. Vent holes are provided to vent fluids trapped above the soil plug in the open-end configuration. If unvented, these fluids would become pressurized as the soil plug enters the pile and would inhibit full formation of the soil plug. A vent valve is used to close the vent holes after the soil plug has formed. This prevents venting of fluids into the soils to be tested.

The axial slip joint is located between the anchor section and the instrument section. The slip joint is adapted to permit relative axial displacement between the instrument section and the anchor section and to measure the amount of such displacement.

The tool is designed to be installed either by pushing or by pile driving. In order to permit installation by pile driving, the instrumentation must be rugged enough to withstand the high impact loads and accelerations which typically occur during pile driving operations.

BRIEF DESCRIPTION OF THE DRAWINGS

The advantages of the present invention will be better understood by referring to the following detailed description and the attached drawings in which.

While the invention will be described in connection with its preferred embodiments, it will be understood that the invention is not limited thereto. On the contrary, it is intended to cover all alternatives, modifications, and equivalents which may be included within the spirit and scope of the invention.

DETAILED DESCRIPTION OF THE PREFERRED EMBODIMENTS

Figure 1:
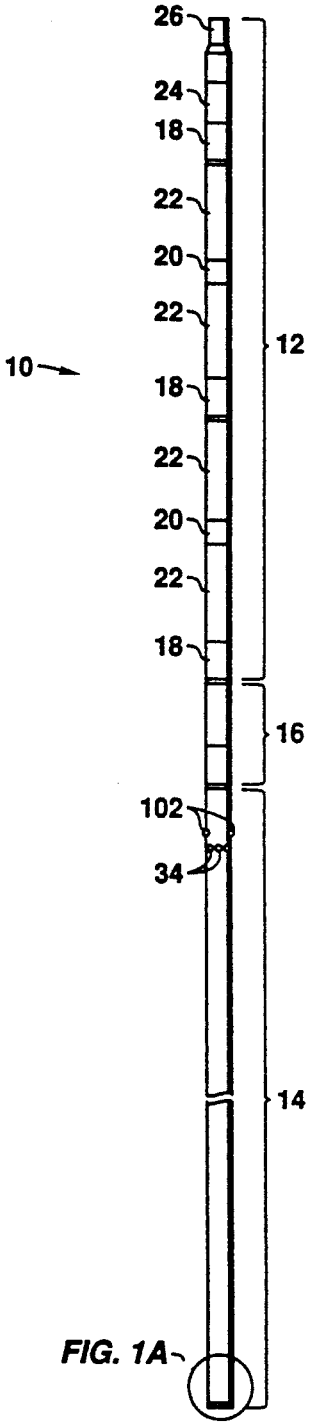
FIG. 1 illustrates one possible configuration of the modular model pile tool of the present invention.
Figure 2:
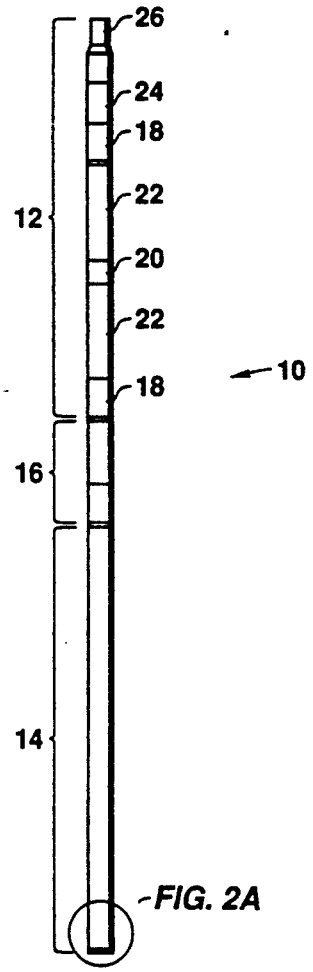
FIG. 2 illustrates another possible configuration of the modular model pile tool of the present invention.

The model pile tool of the present invention utilizes a modular design which permits assembly in various configurations. Two possible configurations are illustrated in FIGS. 1 and 2. Other possible configurations will be apparent to those skilled in the art based on the teachings set forth herein. In any configuration, however, the model pile tool 10 has an upper instrument section 12 and a lower anchor section 14. These two sections are coupled through an axial slip joint 16 located between instrument section 12 and anchor section 14. Model pile tool 10 is capable of measuring (i) axial load at two or more distinct locations, (ii) axial acceleration at any of the axial load measurement locations, (iii) total lateral pressure at locations approximately midway between each adjacent pair of axial load measurement locations, (iv) pore water pressure at approximately the same locations as the total lateral pressure measurement locations, and (v) relative displacement between instrument section 12 and anchor section 14. The outside diameter of model pile tool 10 is approximately 3 inches (although a larger or smaller diameter may be used, if desired), and its overall length is dependent on the particular configuration selected.

In the configuration illustrated in FIG. 1, instrument section 12 comprises three axially spaced apart load cell modules 18, two effective stress modules 20, four couplers 22, connector housing 24, and end cap 26. The effective stress modules 20 are located approximately midway between each adjacent pair of load cell modules 18.

In the configuration illustrated in FIG. 2, instrument section 12 comprises two axially spaced apart load cell modules 18, one effective stress module 20, two couplers 22, connector housing 24, and end cap 26. The effective stress module 20 is located approximately midway between the two load cell modules 18.

Couplers 22 are tubular segments of the desired length having internal threads at both ends for connection to the instrument modules, as more fully described below. Connector housing 24 contains appropriate electrical connections so that wires from the various sensors can be gathered into a single cable. End cap 26 connects the model pile tool 10 to the pipe string extending upwardly to the surface. Appropriate electronic equipment to monitor and record the signals from the various sensors would normally be located at the surface, but could be incorporated into the tool itself.

Figure 1A:
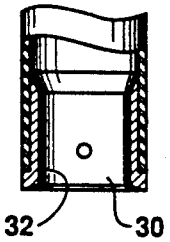
FIG. 1A illustrates the open lower end configuration of the model pile tool of FIG. 1.
Figure 2A:
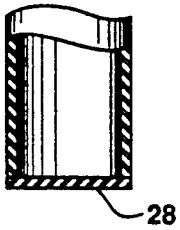
FIG. 2A illustrates the closed lower end configuration of the model pile tool of FIG. 2.

Anchor section 14 can be provided with either a closed lower end 28 (see FIG. 2A) or an open lower end 30 (see FIG. 1A) so as to model closed-end piles and open-end pipe piles, respectively. As illustrated in FIG. 1A, in the open-end configuration, anchor section 14 can be provided with interchangeable cutting shoes 32 so as to model different cutting shoe designs.

As is well known to those skilled in the art, open-end pipe piles permit formation of a soil plug inside the pile as it is driven into the soil. In order to accurately model an open-end pipe pile, it is important that a soil plug be permitted to form in anchor section 14. However, when the model pile tool is lowered into a drilled hole (prior to final installation, as described below), the anchor section typically is filled with air and the drilled hole typically is filled with water and/or drilling fluid. If the anchor section were unvented, some combination of these fluids would be trapped in the lower section and would be pressurized by the entry of the soil plug during final installation of the tool. This build-up of fluid pressures above the soil plug would inhibit full formation of the soil plug. Accordingly, anchor section 14 may be provided with vent holes 34 to prevent the build-up of fluid pressures. As will be more fully described below, a vent valve may also be used to prevent the discharge of fluid from above the soil plug into the test zone.

Anchor section 14 also serves as a fixed elevation datum following installation of the tool. Anchor section 14 may be presumed to remain at the same location during testing. Accordingly, as will be more fully described below, the axial displacement of instrument section 12 during testing may be measured with respect to anchor section 14.

Figure 3A:
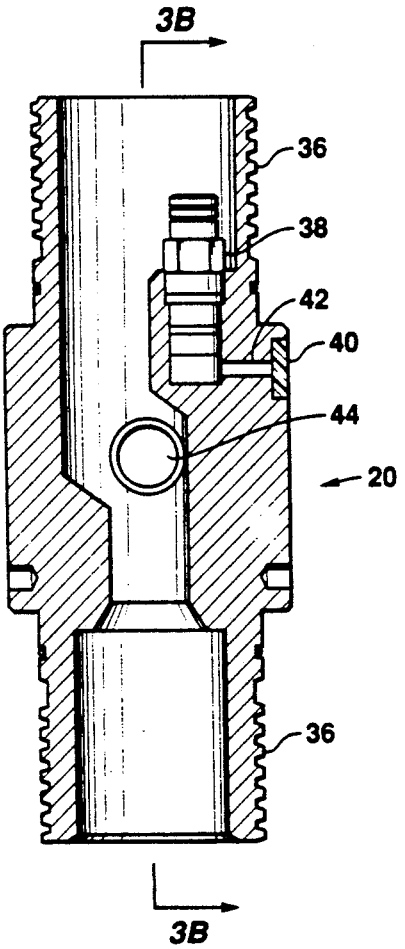
FIGS. 3A and 3B are cross sectional views (taken at 90° to each other) of the effective stress module used in the present invention for measuring pore water pressure and total lateral pressure.
Figure 3B:
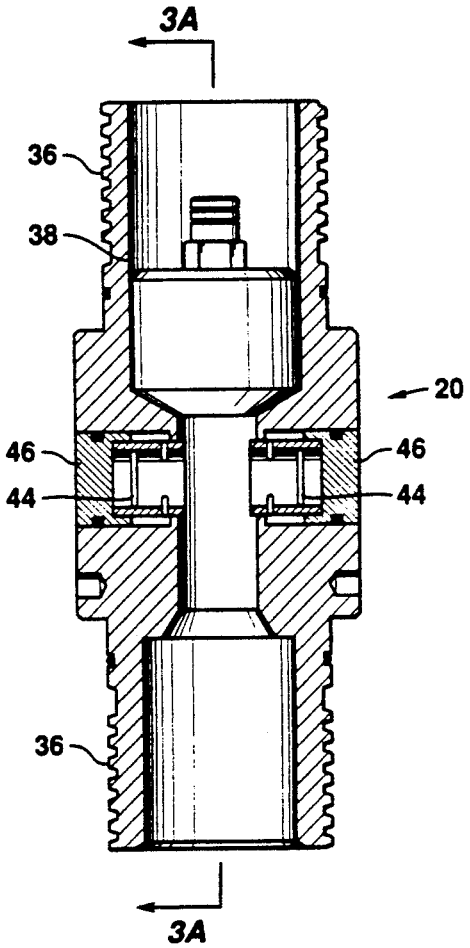

Referring now to FIGS. 3A and 3B, effective stress module 20 comprises an annular housing provided with externally-threaded connections 36 at both ends and the internal instrumentation described below. Connections 36 mate with corresponding internal threads in couplers 22. Measurements of pore water pressure are made using a piezoresistive pressure transducer 38 such as a Kistler 4043A pressure transducer, as marketed by Kistler Instrument Corporation of Amherst, N.Y. One or more porous filters 40 are in fluid communication with transducer 38 via channels 42. The outer surface of each porous filter 40 is shaped to conform to the outer surface of effective stress module 20 in order to minimize disturbances of the surrounding soils.

Total lateral soil pressure is measured using a load cell 44 (see FIG. 3B) with an active face 46 that may be shaped to conform to the outer surface of effective stress module 20. One suitable type of load cell is the Sensotec Model 13 load cell marketed by Sensotec, Inc. of Columbus, Ohio.

Figure 4A:
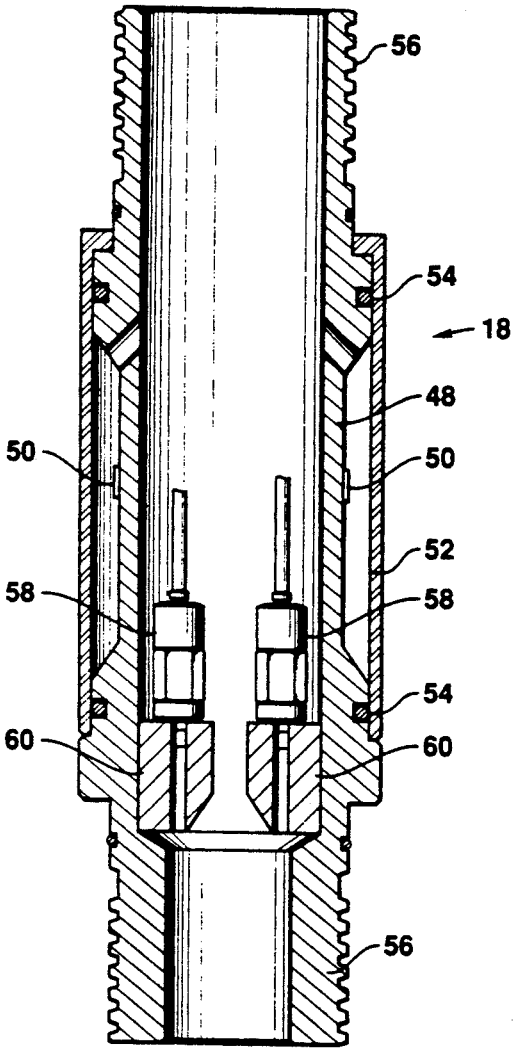
FIG. 4A is a cross sectional view of the load cell module used in the present invention for measuring axial loads and accelerations.
Figure 4B:
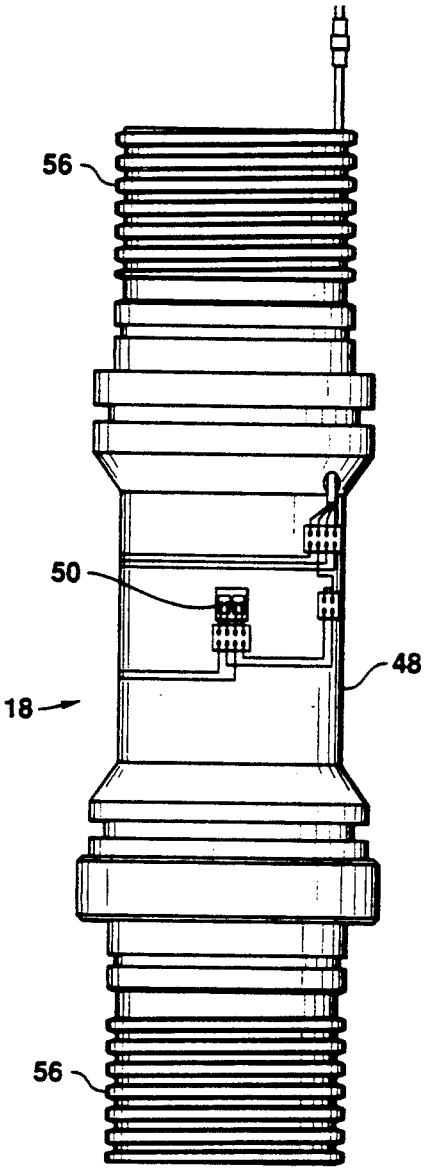
FIG. 4B illustrates the placement of strain gages on the load bearing member of the load cell module.

FIGS. 4A and 4B illustrate the load cell module 18 used in the present invention. The load cell module includes a generally cylindrical load bearing section 48 instrumented with eight foil strain gages 50 wired into a single Wheatstone bridge. The gages are wired so that there are two gages in each arm of the bridge. Typically, these strain gage pairs would be equally spaced around the periphery of load bearing section 48. A removable sleeve 52 sealed by two O-rings 54 is used to protect the strain gages 50 during operation of the tool. Load bearing section 48 is provided with externally-threaded connections 56 at both ends. Connections 56 mate with corresponding internal threads in couplers 22.

The design of load cell module 18 is controlled by the magnitude of the anticipated axial loads. The wall thickness of the load bearing section 48 and the electrical characteristics of the strain gages 50 must be selected to accommodate the expected loads. For many applications, a full scale load range of zero to 40,000 pounds will be acceptable.

Each load cell module 18 also includes two axial accelerometers 58 attached to accelerometer mounts 60 located in the interior of load bearing section 48. Axial accelerometers 58 are used to measure acceleration during driving installation of the tool by pile driving. One suitable type of accelerometer for use in the present invention is a PCB 302A04 quartz accelerometer marketed by PCB Piezotronics, Inc. of Depew, N.Y.

Figure 5:
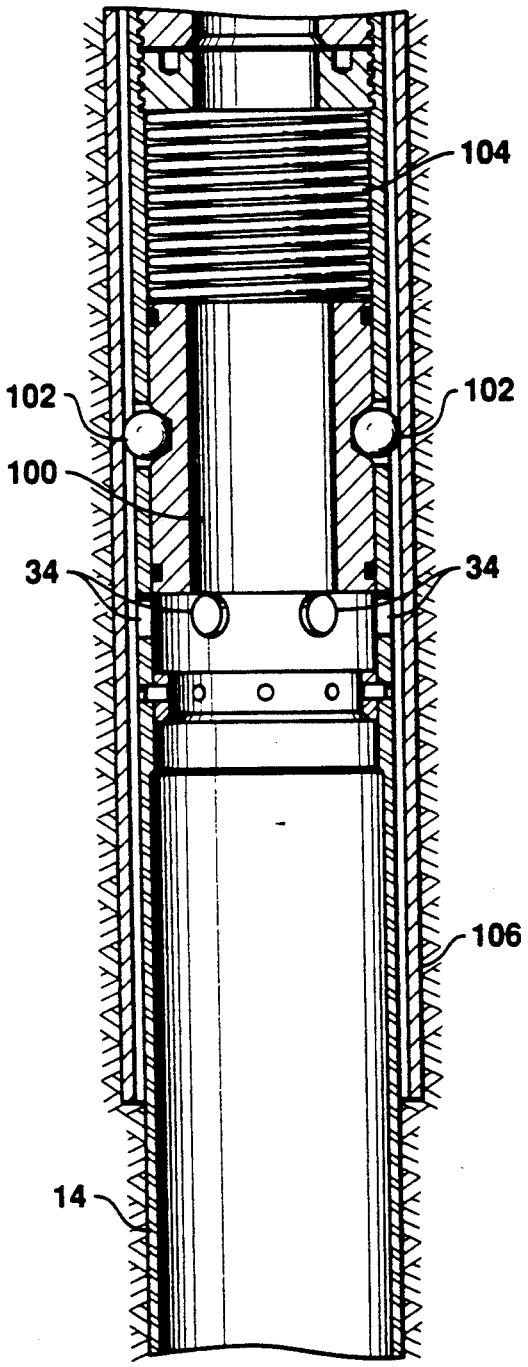
FIG. 5 illustrates the vent valve used in the present invention to prevent the discharge of fluids into the test zone during installation of the tool.

As stated above, a vent valve may be used to prevent the discharge of fluid from above the soil plug into the test zone. FIG. 5 illustrates a suitable vent valve 100. The valve is designed so that it closes when the top of anchor section 14 exits a 3 ¼ inch inside diameter well casing 106 through which it is installed. Prior to this point, the valve is held open by two balls 102 which, in turn, are held in place by the casing 106. This permits fluids above the soil plug to be vented into the casing through vent holes 34. When the balls 102 exit the lower end of the casing 106, actuator spring 104 ejects the balls into the surrounding soils, thereby permitting vent valve 100 to move downwardly, closing vent holes 34. This prevents any fluids above the soil plug from being vented into the soils to be tested.

Figure 6:
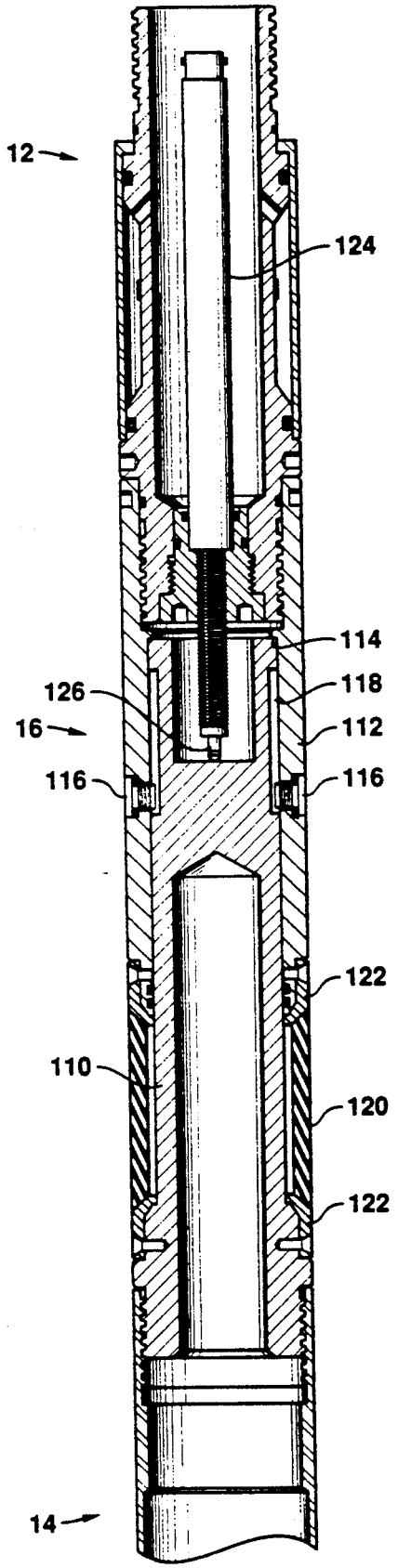
FIG. 6 illustrates the axial slip joint used in the present invention to permit relative axial movement between the anchor section and the instrument section.

FIG. 6 illustrates the slip joint 16 used to permit relative axial movement between anchor section 14 and instrument section 12. Slip joint 16 comprises a slip joint shaft 110 connected to anchor section 14 and a slip joint housing 112 connected to instrument section 12. Slip joint shaft 110 is permitted to telescope into and out of slip joint housing 112. Shoulder 114 in slip joint housing 112 limits inward movement of slip joint shaft 110 and threaded plugs 116 which extend into annular recess 118 prevent slip joint shaft 110 from coming completely out of slip joint housing 112. A rubber sleeve 120 which is attached to and extends between rings 122 is used to minimize dimensional changes during relative movement between instrument section 12 and anchor section 14.

The magnitude of the relative displacement between instrument section 12 and anchor section 14 is measured by linear variable differential transformer 124 (known as an "LVDT") which is mounted in instrument section 12. The movable core 126 of LVDT 124 is spring loaded against slip joint shaft 110. Relative movement between instrument section 12 and anchor section 14 results in movement of movable core 126. This results in a change in the output voltage of LVDT 124 which is proportional to the distance moved. A suitable LVDT is a Schaevitz model GDC-121-1000 marketed by Schaevitz Engineering of Pennsauken, N.J.

Figure 7:
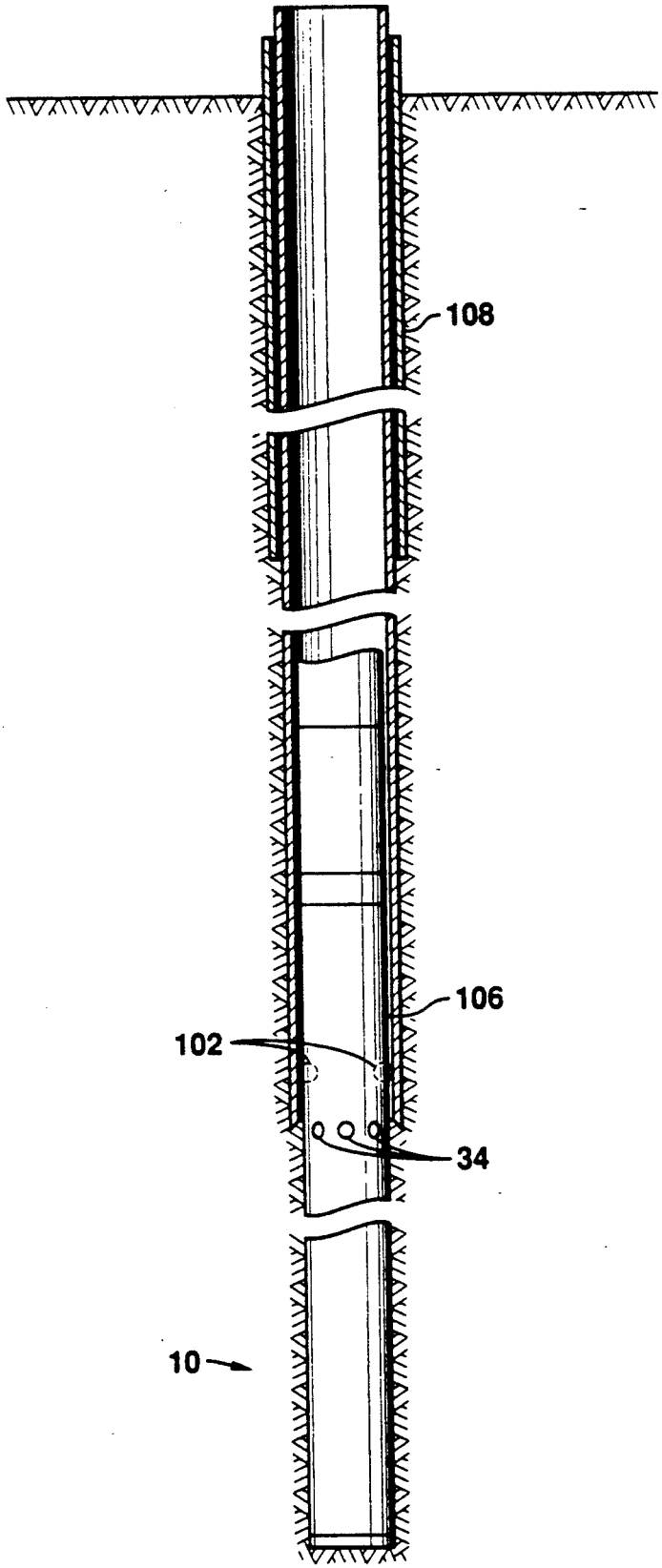
FIG. 7 illustrates the modular model pile tool of the present invention during installation by pile driving.

Operation of the model pile tool of the present invention will now be described. Preferably, the model pile tool 10 is installed through a double casing as illustrated in FIG. 7. Initially, an outer casing 108 is installed to a point approximately ten feet above the desired test zone. Preferably, outer casing 108 is installed by pile driving. Outer casing 108 is then drilled out to its tip and inner casing 106 is installed by pile driving to the top of the test zone. Inner casing 106 is then drilled out to a point just above its tip and the model pile tool 10 is installed to the desire depth. The purpose of these procedures is to minimize disturbances of the soils in the test zone.

The model pile tool 10 may be installed by pushing or by pile driving. During installation, data from all of the transducers described above can be monitored or recorded. Typically, axial load and axial acceleration would be measured for each blow from the pile driving hammer while total lateral pressure and pore water pressure would be measured one or more times between each pair of consecutive hammer blows. Following installation, the tool may be subjected to a variety of steady-state and/or cyclical loadings and the resulting data can be used to predict the behavior of a full scale foundation pile in similar soils.

As described above, the present invention satisfies the need for an in situ geotechnical tool which is capable of being installed in dense soils by pile driving and which can be used to measure dynamic loads and accelerations during installation. It should be understood that the invention is not to be unduly limited to the foregoing which has been set forth for illustrative purposes. Various modifications and alterations of the invention will be apparent to those skilled in the art without departing from the true scope of the invention, as defined in the following claims.

We claim:

1. A device for in situ testing of soils, said device having a longitudinal axis and being adapted to be installed in said soils such that said longitudinal axis is substantially vertical, said device comprising:

(a) a generally tubular upper instrument section;

(b) a generally tubular lower anchor section having (i) an open lower end which permits a soil plug to form within said anchor section during installation of said device into said soils, (ii) a vent valve adapted to remain open during initial installation, until said device has reached a predetermined depth less than the maximum depth said device is to obtain, so as to vent fluids from above said soil plug and to close after said device has reached said predetermined depth so as to prevent said fluids from being vented into the soils to be tested; and (c) an axial slip joint located between said anchor section and said instrument section and adapted to permit relative axial movement between said anchor section and said instrument section.

2. The device of claim 1, wherein said instrument section further comprises:

(a) means for measuring the axial load on said instrument section at two or more axially spaced apart locations;

(b) means for measuring total lateral soil pressure at a point approximately midway between each adjacent pair of axial load measurement locations;

(c) means for measuring pore water pressure at or near each point where total lateral soil pressure is measured; and (d) means for measuring relative axial displacement between said anchor section and said instrument section.

3. The device of claim 1, wherein said instrument section further comprises means for measuring axial acceleration during installation of said device into said soils.

4. A device for in situ testing of soils, said device having a longitudinal axis and being adapted to be installed in said soils such that said longitudinal axis is substantially vertical, said device comprising:

(a) a generally tubular upper instrument section including (i) means for measuring the axial load on said instrument section at two or more axially spaced apart locations, (ii) means for measuring total lateral soil pressure at a point approximately midway between each adjacent pair of axial load measurement locations, (iii) means for measuring pore water pressure at or near each point where total lateral soil pressure is measured, and (iv) means for measuring axial acceleration during installation of said device into said soils;

(b) a generally tubular lower anchor section having;

(i) an open lower end which permits a soil plug to form within said anchor section during installation of said device into said soils, (ii) means to vent fluids from above said soil plug, and (iii) a vent valve adapted to close during installation after said device has reached a predetermined depth less than the maximum depth said device is to obtain, so as to prevent said fluids from being vented into the soils to be tested; and (c) an axial slip joint located between said anchor section and said instrument section and adapted to permit relative axial movement between said anchor section and said instrument section.

5. The device of claim 4, wherein said device further comprises means for measuring relative axial displacement between said anchor section and said instrument section.

* * * * *